US012723406B1

(12) United States Patent
Talalas

(10) Patent No.: US 12,723,406 B1
(45) Date of Patent: Sep. 1, 2026

(54) MULLIONS, MULLION COMPONENTS AND ASSEMBLIES, AND METHODS OF ASSEMBLY AND INSTALLATION

(71) Applicant: INTUS Windows LLC, Fairfax, VA (US)

(72) Inventor: Rolandas Talalas, Haymarket, VA (US)

(73) Assignee: INTUS Windows LLC, Fairfax, VA (US)

( * ) Notice: Subject to any disclaimer, the term of this patent is extended or adjusted under 35 U.S.C. 154(b) by 247 days.

(21) Appl. No.: 18/614,682

(22) Filed: Mar. 24, 2024

Related U.S. Application Data

(60) Provisional application No. 63/491,973, filed on Mar. 24, 2023.

(51) Int. Cl.
*E04B 2/96* (2006.01)

(52) U.S. Cl.
CPC ..... *E04B 2/965* (2013.01); *E04B 2/967* (2013.01)

(58) Field of Classification Search
CPC ..... E04B 2/965; E04B 2/967
See application file for complete search history.

(56) References Cited

U.S. PATENT DOCUMENTS 4,608,793 A * 9/1986 Yost ..... E06B 7/14 52/204.597
2015/0284951 A1* 10/2015 Frederick ..... E04B 2/90 52/235
2017/0298621 A1* 10/2017 Frederick ..... E04B 2/967
2020/0318346 A1* 10/2020 Claeys ..... E04B 2/965
2021/0355679 A1* 11/2021 Newbrough ..... E04B 2/92

FOREIGN PATENT DOCUMENTS

GB 905503 A * 9/1962 ..... E04B 2/967
KR 101737492 B1 * 5/2017 ..... E04B 2/885
WO WO-2004089617 A1 * 10/2004 ..... B32B 17/10036
WO WO-2018191397 A1 * 10/2018 ..... E04B 2/967

OTHER PUBLICATIONS

2019 Intus Window Installation and Connection Mullions.

* cited by examiner

*Primary Examiner* — Theodore V Adamos
(74) *Attorney, Agent, or Firm* — Nemphos Braue LLC; Michael Antone

(57) ABSTRACT

Mullions, mullion assemblies, and methods of mullion installation are disclosed. The mullion may include an outside member having an outer face sufficient to span a distance between the two structural features, e.g., windows, and a depth sufficient to span the thickness of the structural features proximate a first one of the structural features and an inside lip to engage an inside surface of the first structural feature. The mullion may further include a guiding, or mounting, profile having an inside lip to engage an inside surface of the other, i.e., second, structural feature. One or more reinforcement members may be provided between and fastened to the outside member and the guiding profile to provide structural support for the mullion. Mullion connectors may be provided to connect to the outside member and guiding profile and a cap to cover the internal components of the mullion from the inside surface.

15 Claims, 6 Drawing Sheets

FIG. 2
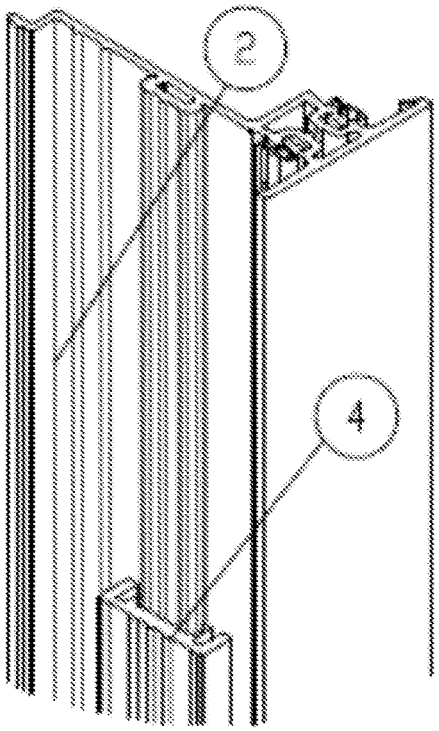
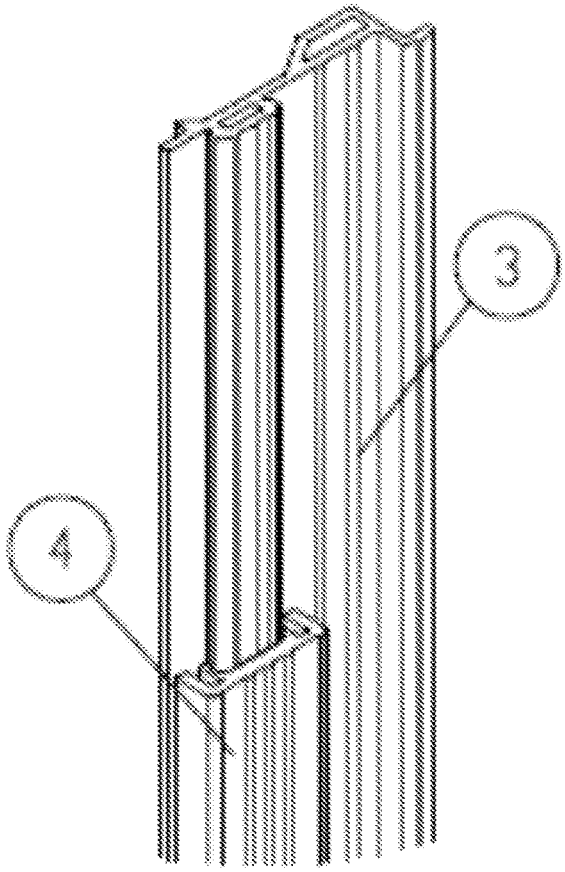
FIG. 3

MULLIONS, MULLION COMPONENTS AND ASSEMBLIES, AND METHODS OF ASSEMBLY AND INSTALLATION

STATEMENT REGARDING FEDERALLY SPONSORED RESEARCH OR DEVELOPMENT

Not Applicable

CROSS-REFERENCE TO RELATED APPLICATIONS

This application claims the benefit of and priority to U.S. Provisional Patent Application No. 63/491,973 filed 2023 Mar. 24, the disclosure of each is incorporated herein by reference in its entirety.

BACKGROUND OF THE INVENTION

Field of the Invention

The present invention generally relates to mullions. More specifically, the invention relates to improved mullions to be installed with multiple windows or other structural features in a building.

Background

Mullions are the vertical elements that are used to separate windows, panels, doors, and other features in a structure. Mullions are often ornamental in design, but a primary purpose is to provide structural support for the features in the structure. For many installations, mullions have to be constructed on site, rather than preassembled in a factory as is the case with windows and doors, which introduces cost and variability into the construction process. As such, constructing mullions on site can represent a significant cost in the installation process. In view of the cost and variability of mullion installation, there is a continuing need for mullions that are less time consuming to assemble on site and provide greater consistency in the results.

BRIEF SUMMARY OF THE INVENTION

The present invention addresses the above noted needs by providing mullions that can be assembled using various mullion components and can be tailored by the installer to the specific opening in the structure and assembled and installed in a consistent manner.

In various embodiments, the mullion may include an outside member that having a length suitable to be installed in an opening between the structural features, such as between two windows, a width of an outer face sufficient to span a distance between the two structural features, and a depth sufficient to span the thickness of the structural features proximate a first one of the structural features and an inside lip to engage an inside surface of the first structural feature. The mullion may further include a guiding profile having an inside lip to engage an inside surface of the other, i.e., second, structural feature. One or more reinforcement members may be provided between and fastened to the outside member and the guiding profile to provide structural support for the mullion. The reinforcement member may be a one-piece or a multi-piece member that generally extends through the depth (thickness) of the windows and may extend beyond the inside surface. Mullion connectors may be provided to connect or engage the outside member and guiding profile with the first and second structural features, respectively. The mullion connectors may be separate parts and/or integrated with the outside member and guiding profile. The mullion may further include a mullion cap or cover configured to engage with the outside member and guiding profile proximate the inside surface of the first and second window to cover or cap internal sections of the mullion.

The mullion of the present invention provides a repeatable mullion structure that may be assembled quickly and reliably at a work site. Accordingly, the present disclosure addresses the continuing need for improved mullions that reduce installation costs and improve reliability.

BRIEF DESCRIPTION OF THE DRAWINGS

The accompanying drawings are included for the purpose of exemplary illustration of various aspects of the present invention, and not for purposes of limiting the invention, wherein:

FIGS. 2-7 depict exemplary assembly steps of the components in the embodiments of FIGS. 1A-1D.

Figures 1A, 1B:
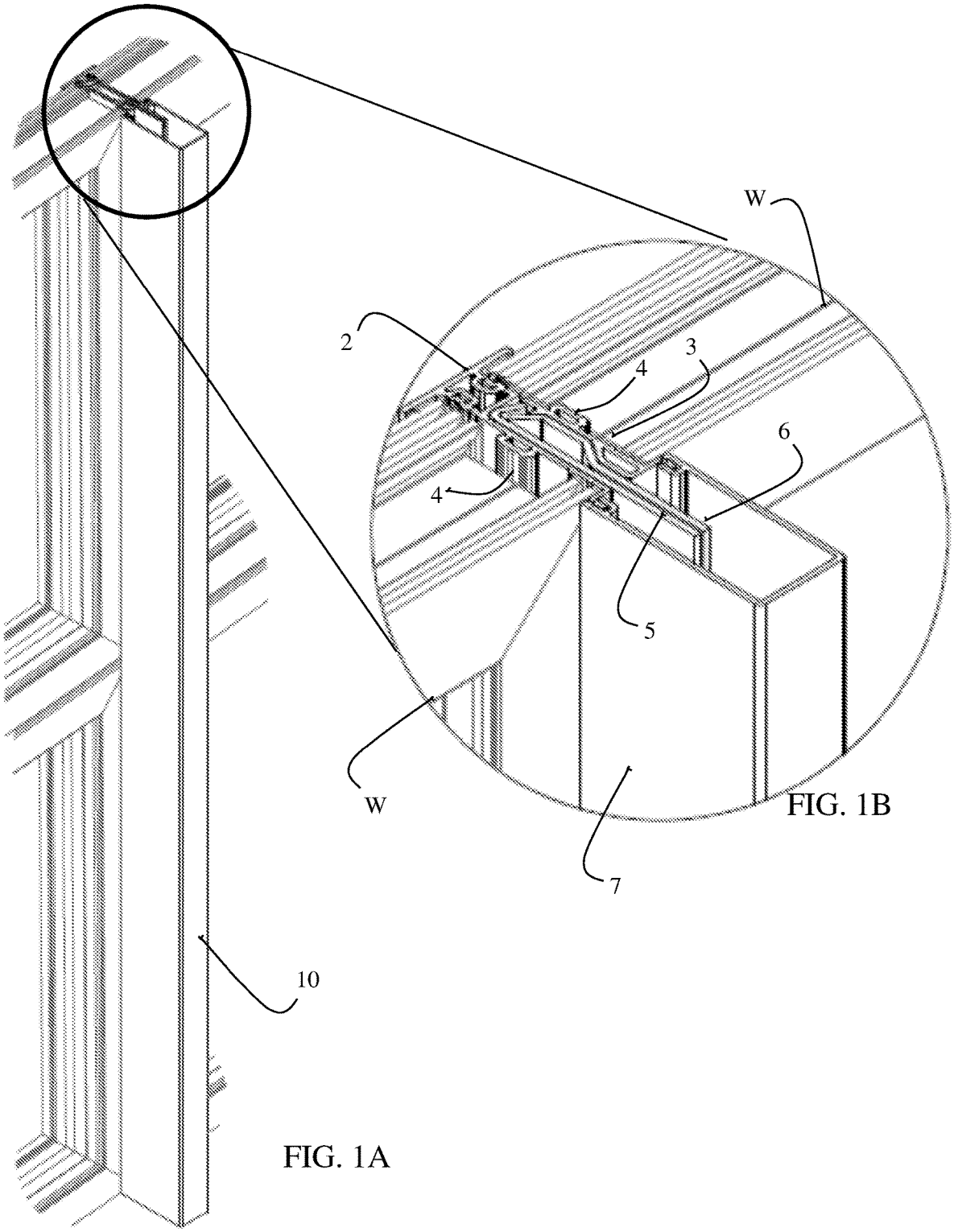
FIGS. 1A-1D show various views of exemplary components in various mullion embodiments.

In the drawings and detailed description, the same or similar reference numbers may identify the same or similar elements. It will be appreciated that the implementations, features, etc. described with respect to embodiments in specific figures may be implemented with respect to other embodiments in other figures, unless expressly stated, or otherwise not possible.

DETAILED DESCRIPTION OF THE INVENTION

Mullions 10 of the present invention may be employed in various vertical elements that are used to separate windows, panels, doors, and other features in a structure.

Figure 1C:
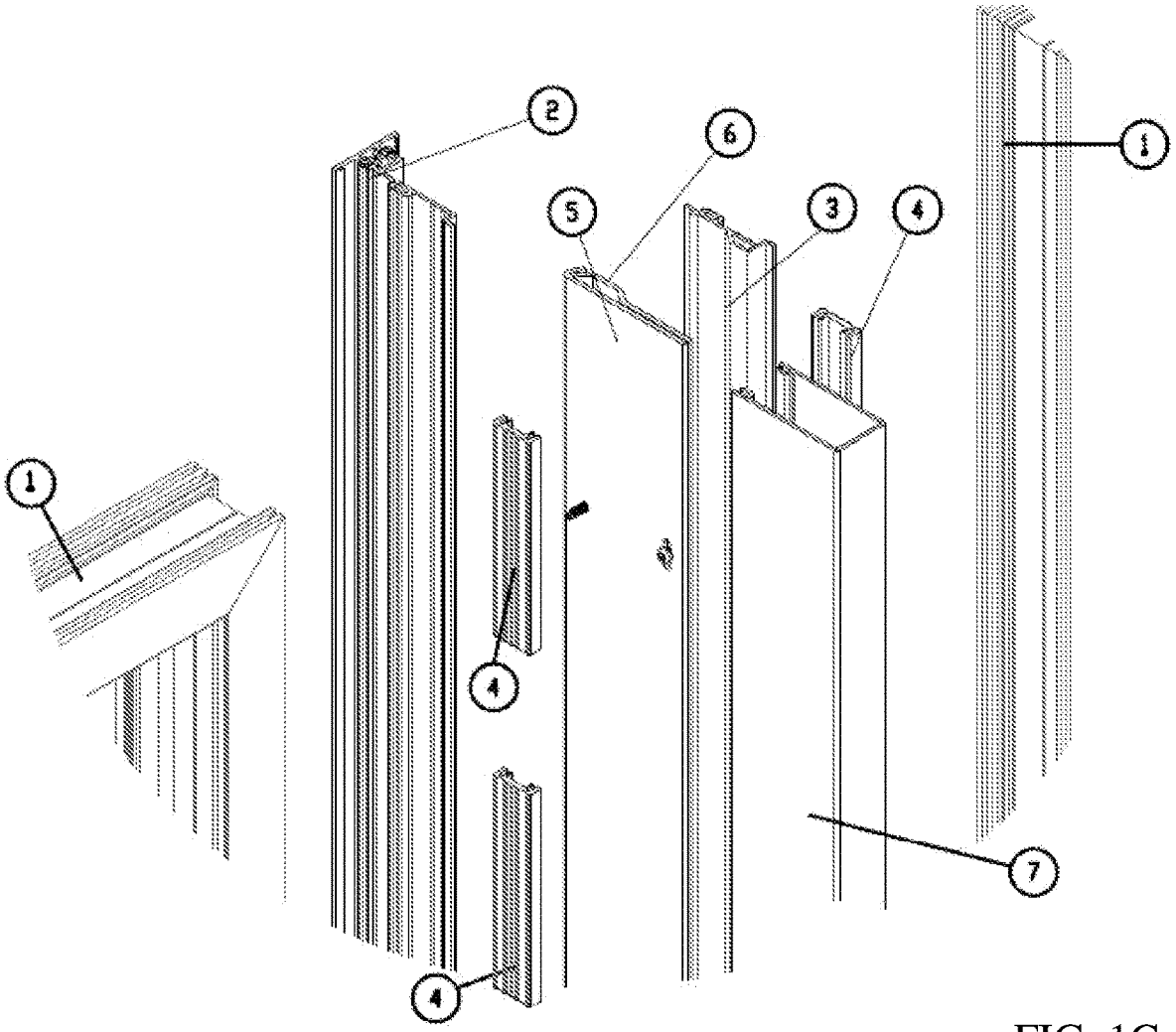
Figure 1D:
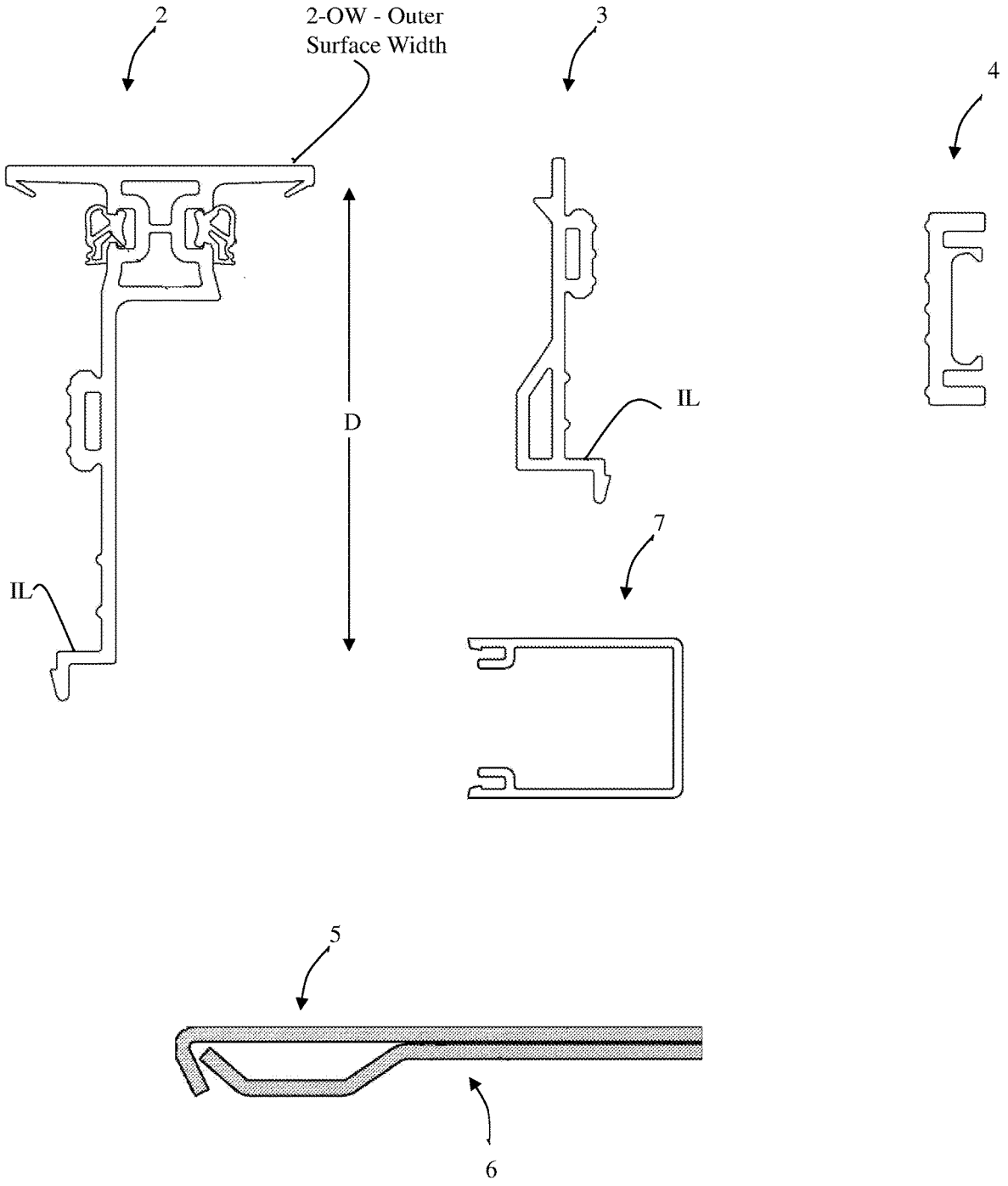

FIGS. 1A-1D show various views of exemplary components in various embodiments of the inventive mullions 10. FIG. 1A shows a perspective view of the mullion 10 installed between two windows W with an enlarged section (FIG. 1B) showing various exemplary components that may comprise the mullion 10. FIG. 1C shows a partial exploded view of the mullion 10 components depicted in FIGS. 1A-1B. FIG. 1D shows cross-sectional views of the mullion 10 components depicted in FIGS. 1A-1C.

In various embodiments, the mullion 10 includes an outside member 2 having a length suitable to be installed in an opening between the structural features, such as between two windows, a width of an outer face 2-OW sufficient to span a distance between the two structural features, and a depth D sufficient to span the thickness of the structural features proximate a first one of the structural features and an inside lip IL to engage an inside surface of the first structural feature. The outer face 2-OW of the outside member 2 may include lips to form a seal with the windows W when installed. The outer face 2-OW may have various ornamental features, while achieving a primary purpose of sealing the gap between two windows.

The mullion 10 further includes a mounting, or guiding, profile 3 having an inside lip IL to engage an inside surface of the other, i.e., second, structural feature, e.g., window. In various embodiments, the guiding profile 3 does not extend the full depth of the window, but only a portion of the window from the inside surface (facing indoors). In various embodiments, the guiding profile 3 may extend proximate to or engage the outer member 2.

In various embodiments, mullion connectors 4 may be employed to provide for attachment to the outside member 2 and/or the guiding profile 3 to provide additional structural support and/or maintain alignment of the mullion with the windows during installation. It will be appreciated that mullion connectors 4 may have various sizes, shapes, and lengths to accommodate various windows or other structural feature designs and that, in various embodiments of the mullions 10, no connector 4 are employed and/or the functionality of the connectors 4 may be integrated into the outside member 2 and/or the guiding profile 3. In various embodiments, the mullion connectors 4 and the outside member 2 and the guiding profile 3 are designed to provide a cooperative connection. For example, in FIGS. 1A-1D, the mullion connectors 4 and the outside member 2 and the guiding profile 3 are designed to provide a slide on engagement between the components that allow the connector 4 to slide along the length of the outside member 2 and the guiding profile 3 and multiple connectors 4 to be positioned as desired by the artisan.

In various embodiments of the mullions 10, reinforcement members 5 and 6 may be provided that are fastened the outside member 2 and guiding profile 3 to provide structural support for the mullion 10. The reinforcement members 5 and 6 may be configured to cooperate when the windows W are installed to limit, reduce, or prevent relative movement of the mullion components and the windows W, such as in the planes parallel and perpendicular to the windows W. As shown in FIGS. 1A, 1B, and 1D, the reinforcement member may be configured with a slip fit in the depth direction of the window (i.e., perpendicular to the plane of the window) to prevent movement in the plane of the window. In addition, it may be desirable to fasten the reinforcement members 5 and 6 together using one or more fasteners 8 to further limit movement of the windows W. The reinforcement members 5 and 6 may be configured to extend through the depth (thickness) of the windows and may extend beyond the inside surface. As with the mullion connector 4, the reinforcement members 5 and 6 may be a single component or comprise more than two components and/or the reinforcement functionality may be integrated with the outside member 2 and guiding profile 3 components.

In various embodiments, a cap or cover 7 may be employed to enclose or cover the interior of the mullion 10 and may be used to provide structural support of the mullion and for aesthetics. The cap 7 may be of various sizes depending upon the other components in the mullion 10 and the desired appearance of the mullion 10. The cap 7 may be configured to cooperate with and attach to the inside lips IL of the outside member 2 and guiding profile 3 in a snap-on configuration to hide the fastening mechanism. Alternatively, visible fasteners may be employed.

The various components of the mullion 10 may be made using the same or different materials and one or more materials. For example, outside member 2 may be made from a material that may serve as a gasket and provide an efficient seal against the outside frame of the window and aesthetically matches the design of the window, such as various types of plastics. The guiding profile 3 and mullion connector 4 may not generally be visible when installed, so the materials may be selected based on various factors, such as cost and material properties, but not necessarily aesthetics. The reinforcement members 5 and 6 may not be visible following installation and may generally be made of one or more materials that will provide structural support to the mullion, such as structural metals. The cap 7 may be employed purely for aesthetics or may also be employed to provide structural support and the materials for use may be selected accordingly. It will be further appreciated that one of skill in the art can vary the cross-sectional features of the various components to provide gaskets and increase the tortuosity of and pressure drop through leakage paths in the mullion 10, as well as for ease of installation and aesthetics.

FIGS. 2-7 depict exemplary assembly steps of the components in the embodiments of FIGS. 1A-1D. It will be appreciated that when installing the mullion 10 with windows W or other structural features that it is desirable to apply sealants to the various junctions of the components in the mullion 10 to reduce or eliminate air leakage paths through the mullion 10 and between the mullion 10 and the windows W.

Figure 4:
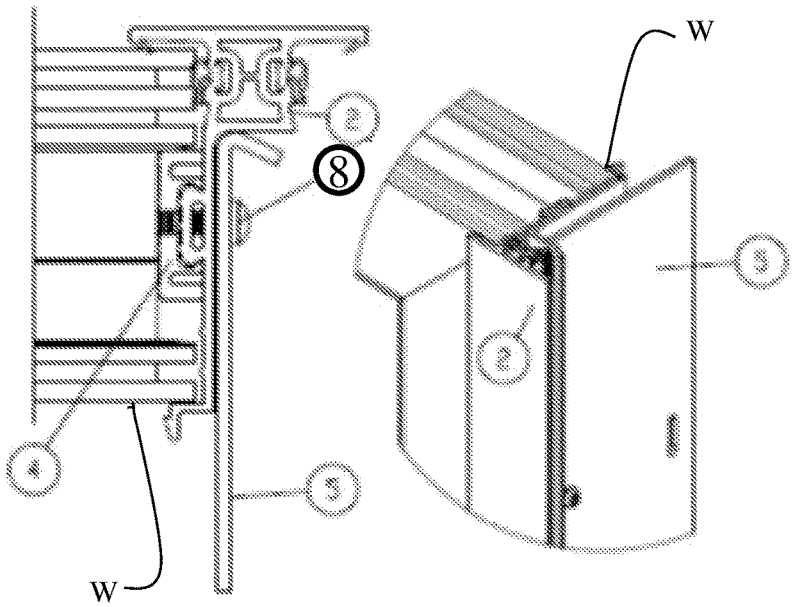
Figure 5:
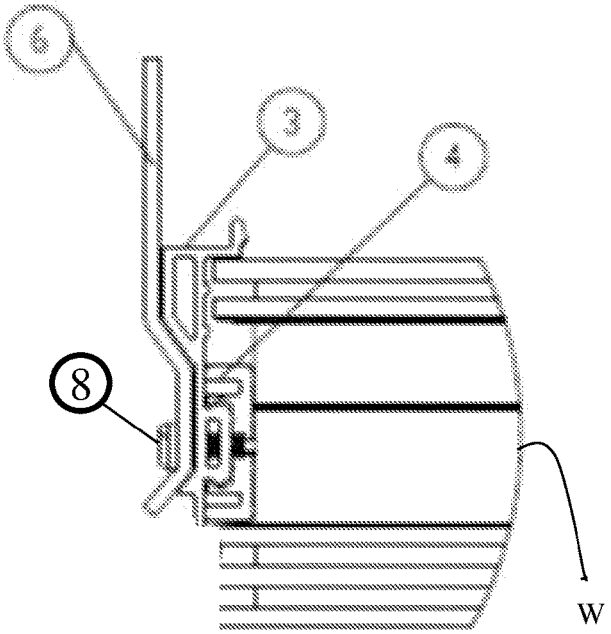

As shown in FIGS. 2 & 3, one or more mullion connectors 4, if employed, may be connected to the outside member 2 and guiding profile 3 and positioned along the length to provide positioning and support to the mullion 10. As shown in FIGS. 4 & 5, reinforcement members 5 and 6 may be attached to the outside member 2 and guiding profile 3, respectively, using, for example, a fastener 8, such as a screw, to provide a reinforced outside member 2 and reinforced guiding profile 3. The reinforced outside member 2 and guiding profile 3 are then attached to respective windows, or other structural features. It will be appreciated that the fastener 8 used to connect the reinforcement members may also be configured to attach the reinforced outside member 2 and/or guiding profile 3 to the respective window W or may be solely used to fasten together the components of the reinforced outside member 2 and/or guiding profile 3. As further shown in FIGS. 4 & 5, the reinforced outside member 2 is positioned along the edge of the window W, so the outside and inside portion of the outside member 2 engage the outer and inner surface of the window W, respectively, and the reinforced guiding profile 3-6-4 is positioned so the inner lip IL engages the inner surface of the second window.

Figure 6:
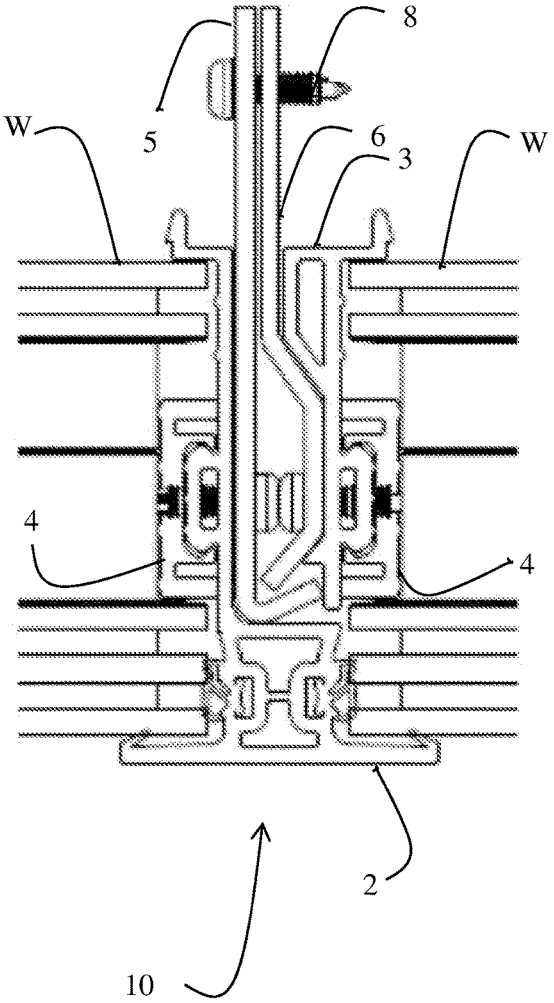

FIG. 6 depicts a cross-sectional view of the mullion 10 fully assembled and positioned between two windows W. As depicted in FIG. 6, the windows W, with the attached reinforced outside member 2 and reinforced guiding profile 3, are positioned, such that reinforcement members 5 and 6 engage to prevent, reduce, or limit movement of the mullion 10 and windows W parallel or perpendicular to the plane of the windows W. A fastener 8, such as a screw or bolt and nut, may be used to join the reinforcement members 5 and 6 to provide additional structural support to and alignment of the mullion 10. It will be appreciated that while it appears in FIGS. 6 and 7 that the fasteners 8 passing through the reinforced outside member 2 and/or guiding profile 3 may be in the same plane and perhaps touching, it is not required that the fasteners 8 be in the same plane or touching, but should be configured to allow the windows W and the reinforcement members 5 and 6 to be properly positioned.

Figure 7:
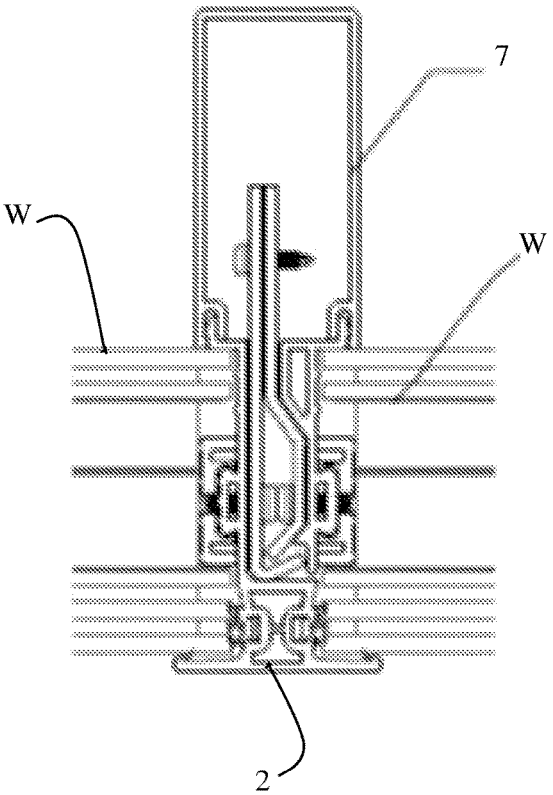

FIG. 7 depicts the installed cap 7 on the assembled mullion of FIG. 6. In these embodiments, the cap 7 attaches to the inner lips IL of the outside member 2 and guiding profile 3 with a mating snap-on connector that may be removed by applying pressure and which hides the fastener for aesthetic purposes. It will be appreciated that other types of fasteners may be employed to connect the cap 7 to the outside member 2 and/or guiding profile 3.

The foregoing disclosure provides examples, illustrations and descriptions of the present invention, but is not intended to be exhaustive or to limit the implementations to the precise form disclosed. Modifications and variations are possible in light of the above disclosure or may be acquired from practice of the implementations. These and other variations and modifications of the present invention are possible and contemplated, and it is intended that the foregoing specification and the following claims cover such modifications and variations.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items and may be used interchangeably with "one or more." Furthermore, as used herein, the term "set" is intended to include one or more items and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A mullion assembly comprising:

an outside member having an inner lip configured to engage an inside surface of a first window, an outer surface configured to engage an outside surface of the first window, and an outside surface of a second window, and a depth spanning the inside to outside surfaces of the first window, and second windows configured to be attached to the first window; and a guiding profile having an inner lip configured to engage an inside surface of the second window, wherein the outside member and the guiding profile are physically separate elements and the guiding profile is configured to be attached to the second window without being connected to the outside member; and first and second reinforcement members, the first reinforcement member configured to attach to the outside member, the second reinforcement member configured to attach to the guiding profile, and the first and second reinforcement members being configured to cooperate to at least reduce movement of the first and second windows parallel and perpendicular to a plane of the windows and be fastened together.

2. The mullion assembly of claim 1, further comprising at least one mullion connector configured to engage at least one of the outside member and guiding profile on a surface opposing a surface engaging a corresponding one of the first and second reinforcement members.

3. The mullion assembly of claim 1, wherein the first and second reinforcement members are fastened together following attachment of the first reinforcement member to the outside member and the second reinforcement member to the guiding profile.

4. The mullion assembly of claim 1, wherein the first and second reinforcement members extend beyond the inner surface of the first and second windows and are fastened together following attachment of the first reinforcement member to the outside member and the second reinforcement member to the guiding profile.

5. The mullion assembly of claim 1, further comprising a cap configured to span a width between the inner surfaces of the first and second windows.

6. The mullion assembly of claim 1, further comprising a cap configured to span a width between the inner surface of the first and second windows and connect to at least one of the outside member and guiding profile.

7. The mullion assembly of claim 1, where the outside member and guiding profile are made of plastic; and the first and second reinforcement members are made of metal.

8. A mullion assembly comprising:

an outside member having an inner lip configured to engage an inside surface of a first window, an outer surface configured to engage an outside surface of the first window and an outside surface of a second window, and a depth spanning the depth of the first and second windows;

a guiding profile having an inner lip configured to engage an inside surface of the second window, wherein the outside member and the guiding profile are physically separate elements;

one or more mullion connectors configured to be positioned between and connect at least one of the outside member to the first window and the guiding profile to the second window;

first and second reinforcement members, the first reinforcement member configured to attach to the outside member, the second reinforcement member configured to attach to the guiding profile, the first and second reinforcement members being configured to cooperate to reduce movement of the first and second windows parallel and perpendicular to the plane of the windows and be fastened proximate the inner surface of the windows; and a cap configured to cover the first and second reinforcement members, outside member, and guiding profile.

9. The mullion assembly of claim 8, where the cap includes a snap-on connector to connect the cap to the outside member and the guiding profile.

10. The mullion assembly of claim 8, where the one or more mullion connectors are configured to slide onto at least one of the outside member and guiding profile.

11. The mullion assembly of claim 8, where the first and second reinforcement members extend beyond the inner surface of the first and second windows.

12. A method of assembling a mullion with two windows comprising:

providing an outside member having an inner lip configured to engage an inside surface of a first window, an outer surface configured to engage an outside surface of the first window and an outside surface of a second window, and a depth spanning the depth of the first and second windows;

providing a guiding profile having an inner lip configured to engage an inside surface of the second window, wherein the outside member and the guiding profile are physically separate and not directly attached;

attaching a first reinforcement member to the outside member;

attaching a second reinforcement member to the guiding profile;

attaching the outside member to a side edge of the first window;

attaching the guiding profile to a side edge of the second window;

positioning the second window so the first and second reinforcement members cooperate to reduce relative movement between the first and second windows; and the outside surface of the second window engages the outer surface of the outside member; and fastening the first and second reinforcement members together.

13. The method of claim 12, further comprising connecting at least one connector to the outside member to be positioned between the outside member and the first window when installed and at least one connector to the guiding profile to be positioned between the guiding profile and the second window when installed.

14. The method of claim 12, further comprising placing a cap proximate the inside surface of at least one of the first and second windows to cover the first and second reinforcement members, outside member, and guiding profile and span between the inner surfaces of the first and second windows.

15. The method of claim 14, where placing the cap includes connecting the cap to the outside member and guiding profile via a snap-on connector.

* * * * *